United States Patent [19]

Ament

[11] Patent Number: 4,987,616

[45] Date of Patent: Jan. 29, 1991

[54] WATER SAVER WATER CLOSET

[75] Inventor: Myron J. Ament, Plano, Tex.

[73] Assignee: Eljer Manufacturing, Inc., Plano, Tex.

[21] Appl. No.: 256,992

[22] Filed: Oct. 13, 1988

[51] Int. Cl.[5] ..... E03D 11/08; E03D 11/18

[52] U.S. Cl. ..... 4/421; 4/428

[58] Field of Search ..... 4/428, 430, 420, 421, 4/424

[56] References Cited

U.S. PATENT DOCUMENTS

| | | | |
|---|---|---|---|
| 548,239 | 10/1985 | Wells | 4/348 |
| 705,319 | 7/1902 | Bush | 4/420 |
| 742,014 | 10/1903 | Ek | 4/428 |
| 770,027 | 9/1904 | Tilden | 4/428 |
| 854,653 | 5/1907 | Knapp | 4/348 |
| 2,164,320 | 7/1939 | Groeniger | 4/7 |
| 2,616,094 | 11/1952 | Cramer | 4/428 |
| 3,212,106 | 10/1965 | Noel | 4/421 |
| 3,538,518 | 11/1970 | Helke | 4/10 |
| 4,162,458 | 7/1979 | Groombridge et al. | 4/300 |
| 4,197,599 | 5/1980 | Tsai | 4/424 |
| 4,277,854 | 7/1981 | Tsai | 4/420 |

OTHER PUBLICATIONS

The front cover and pp. 2 and 8 of the undated Aqua-Line Catalog entitled "Fixture" show Exterior Portion of the Water Closet.

*Primary Examiner*—Henry J. Recla
*Assistant Examiner*—Robert M. Fetsuga
*Attorney, Agent, or Firm*—Harness, Dickey & Pierce

[57] ABSTRACT

A water closet has a flush tank which reduces the head of flush water presented to a downwardly converging bowl which receives waste to be discharged through an outlet to a siphon trap, the bowl having a rim which causes the flush water to be presented to the trap in a vortex fashion. The trap is U-shaped and includes an upleg and downleg, the upleg having a converging-diverging cross-section to cause the dischrge to be pushed quickly from the bowl into the downleg, which becomes filled and creates a siphon. As waste travels down the downleg it passes through an expansion chamber which imparts a swirling movement to the waste and is again restricted at the outlet, which prevents air from entering the trapway and breaking the siphon.

20 Claims, 4 Drawing Sheets

WATER SAVER WATER CLOSET

BACKGROUND AND SUMMARY OF THE INVENTION

The present invention generally relates to a water closet and more particularly to a flush water arrangement to minimize the amount of water expended during the flushing operation.

A water closet typically includes a flush tank, a bowl, and a siphon trap to discharge waste from the bowl and prevent gases and waste water from flowing back into the bowl. Efficient water closet performance is a balance between that volume of falling water needed to fill the bowl, either directly from the tank or indirectly from a flush rim which encircles the bowl, and the rate of flow of flush water into the trap required to start and maintain a vacuum in the siphon trap during the flush operation.

Residential homes and buildings are typically equipped with only a single water supply system providing only potable water, irrespective of the uses intended thereof by the resident. Water conservation is now important, especially in the various sunbelt states, and unnecessary consumption of potable water from water closet usage represents an area where water conservation can be achieved. For example, while a typical U.S. water closet consumes about 3.0 gallons of flush water, a conventional European water closet is more water efficient and only uses about 1.5 gallons of water in a thrust-type flushing action. However, this thrust-type action lacks a swirling action which is necessary to clean the interior sidewalls of the bowl. A desirable water closet would efficiently utilize the lower amount of water without sacrificing the benefits gained by thrust and swirling action imparted by the flush water.

One approach to save water is to make the water closet smaller and equip the closet with restrictors to limit the flush water from the tank and thereby render the flushing water more effective. While use of a separate device constitutes a step in the right direction, it would be desirable to have a self-contained water closet which reduces the amount of water required per flush by making the flushing operation more efficient.

A slow discharge of waste has a further unexpected disadvantage. As the discharge leaves the closet it must travel a significant distance to reach the community sanitary system. If the sewage pipes are too great in diameter, the waste will not fill the pipe and tend to form on the pipe wall, resulting in clogged lines. A faster discharge will obviate this situation by acting to scrub the pipe walls.

Accordingly, an object of the invention is provision of a water closet which efficiently uses a substantially reduced head of flush water that cleans the bowl without appreciably affecting the flushing action of the water being discharged and without raising the average head under which this smaller amount of flushing water is delivered.

In accordance with this invention there is provided a water closet including a frusto-pyramidal flush tank expanding vertically downwardly, a downwardly converging bowl including a top flushing rim section receiving flush water from the tank and a lower outlet opening for discharging waste material from the bowl, a conduit for supplying fresh flush water from the tank to the bowl, and a trapway connecting the lower outlet of the bowl to the discharge opening, the bottom part of the bowl and trapway forming a water trap for the sealing function. The trapway forms a continuous passageway described by a specially configured inverted "U" which includes an upleg portion which extends vertically upward from an orifice that defines a contracting expanding nozzle where connected to the bowl outlet, a transition portion which defines the free water level in the main part of the bowl, and a downleg portion which snakes vertically downward from the transition to a discharge opening whereby to pass the waste from the closet. The rim section rapidly supplies fresh flush water to the bowl in a vortex motion to center the waste for entrance into the trapway. The orifice adjacent the bowl outlet communicates waste from the water trap and increases the velocity of the effluent from the bowl. Thereafter, the upleg passage expands in cross-section to receive all waste discharged from the bowl. The transition portion is reduced in cross-section to rapidly become filled and create a siphon in the downleg. As the waste material travels down the downleg the passage expands to form an expansion chamber and then contracts to form an orifice adjacent the discharge opening, the chamber cooperating with the downleg to impart a swirling movement in the waste flow to prevent entry of air into the downleg orifice which could break the siphon action.

Advantageously, the upleg portion allows the waste to be accelerated from the bowl ahead of the flush water with the flush water head rapidly emptying into the bowl to provide the acceleration. Provision of an expansion chamber adjacent the inlet and outlet, respectively, surprisingly allows the siphon action to initiate sooner and not be disturbed during the flushing. This results in substantially less flush water being required for a like flush.

Slow flush water input develops less siphon action in the trap resulting in the waste in the bowl water trap tending to rise to the top of the free surface of the water in the bowl and be the last to be discharged from the bowl. Advantageously, the downwardly converging bowl with the slotted water feed rim rapidly imparts a swirling action to scrub the bowl wall and center the waste for discharge, and the area increase in the upleg, adjacent the transition portion of the closet, defines an expansion chamber that assists in rapid movement of waste material to fill the downleg and start the siphon. The expansion chamber in the downleg adjacent the discharge opening imparts a swirling movement to the waste to prevent turbulence in the flush water, thereby inhibiting air which could break the siphon from entering the downleg.

Other advantages and features will become apparent from the following specification taken in connection with the accompanying drawings.

DETAILED DESCRIPTION OF THE PREFERRED EMBODIMENT

Figure 1:
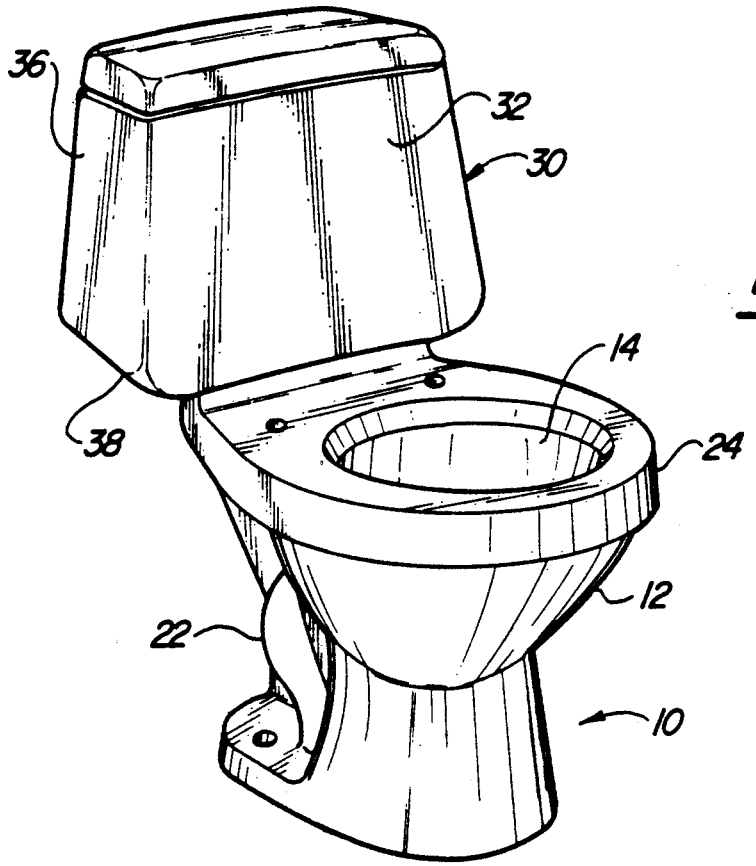
FIG. 1 is a persepective view of a water closet in operative association with a flush tank.
Figure 2:
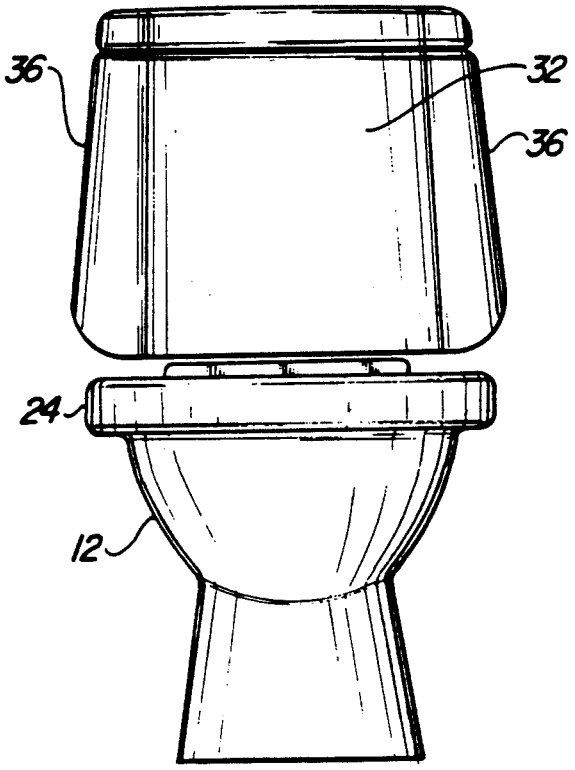
FIG. 2 is a front elevation view of the water closet shown in FIG. 1.
Figure 4:
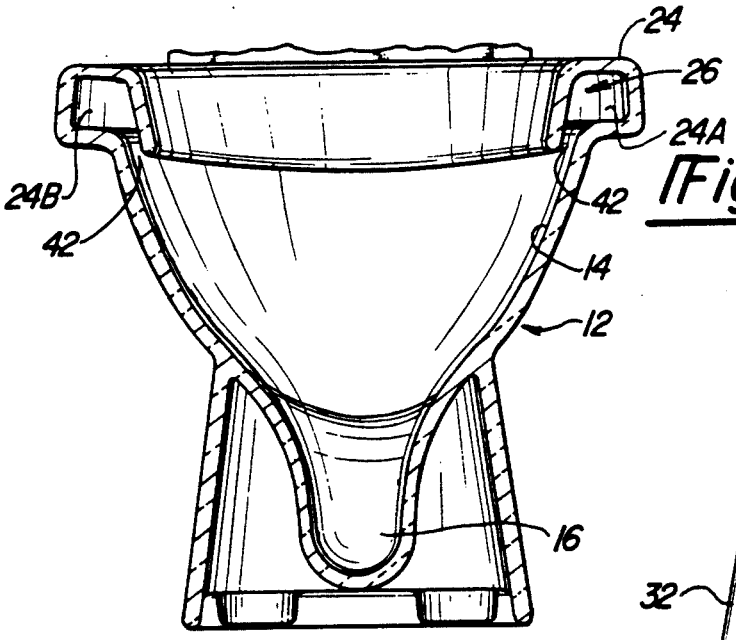
FIG. 4 is an elevation view in section taken along line 4—4 of FIG. 3 and 4—4 of FIG. 7.
Figure 3:
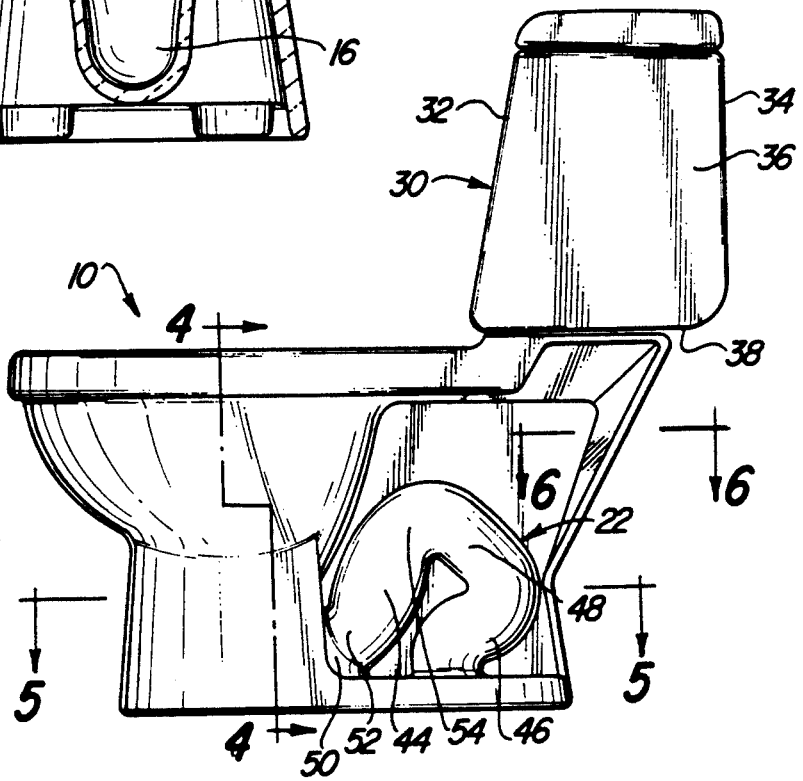
FIG. 3 is a side elevation view of the water closet shown in FIG. 1.
Figure 5:
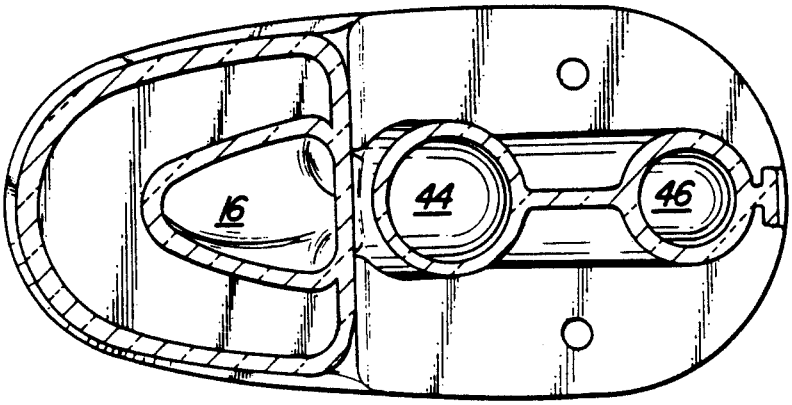
FIGS. 5 and 6 are horizontal plan views in section taken, respectively, along lines 5—5 and 6—6 of FIG. 3.
Figure 6:
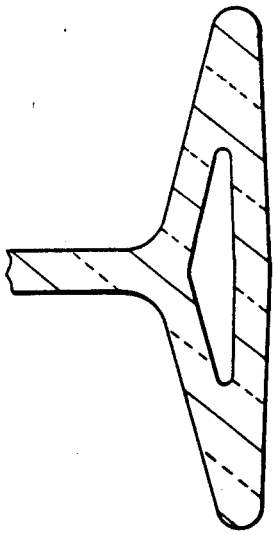
Figure 7:
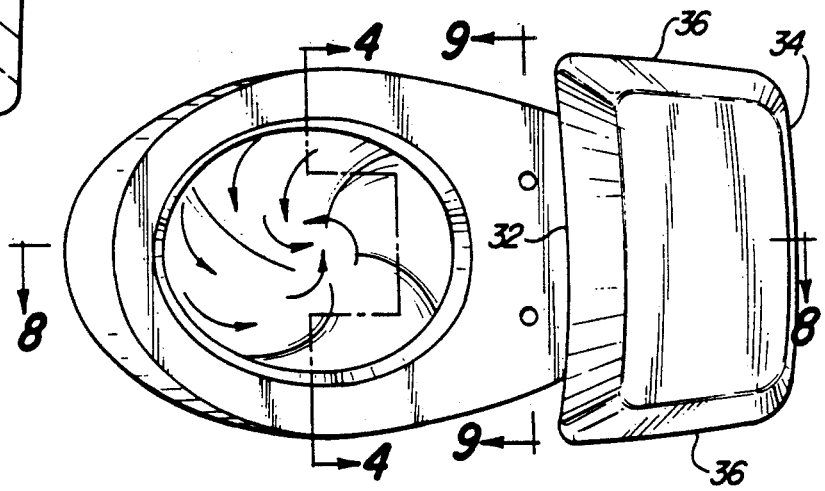
FIG. 7 is a horizontal plan view of the water closet shown in FIG. 1.
Figure 8:
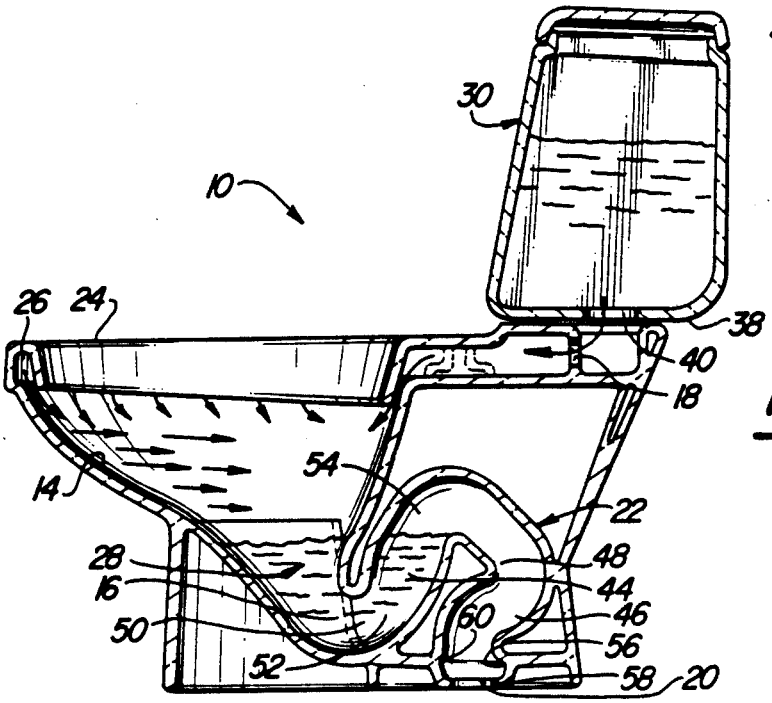
FIG. 8 is an elevation view of the water closet and flush tank section taken along line 8—8 of FIG. 7.
Figure 9:
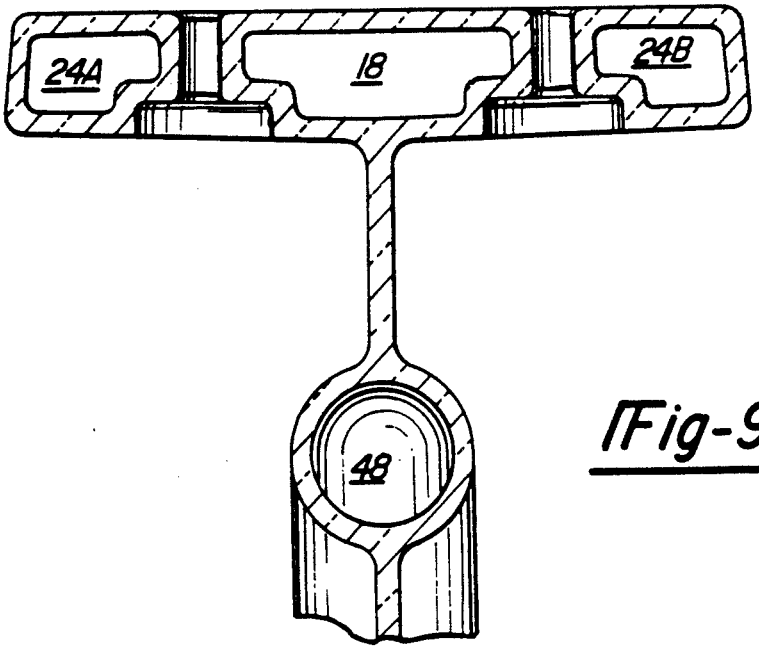
FIG. 9 is an elevation view in section taken along lines 9—9 in FIG. 7 of water inlet passage.
Figure 10:
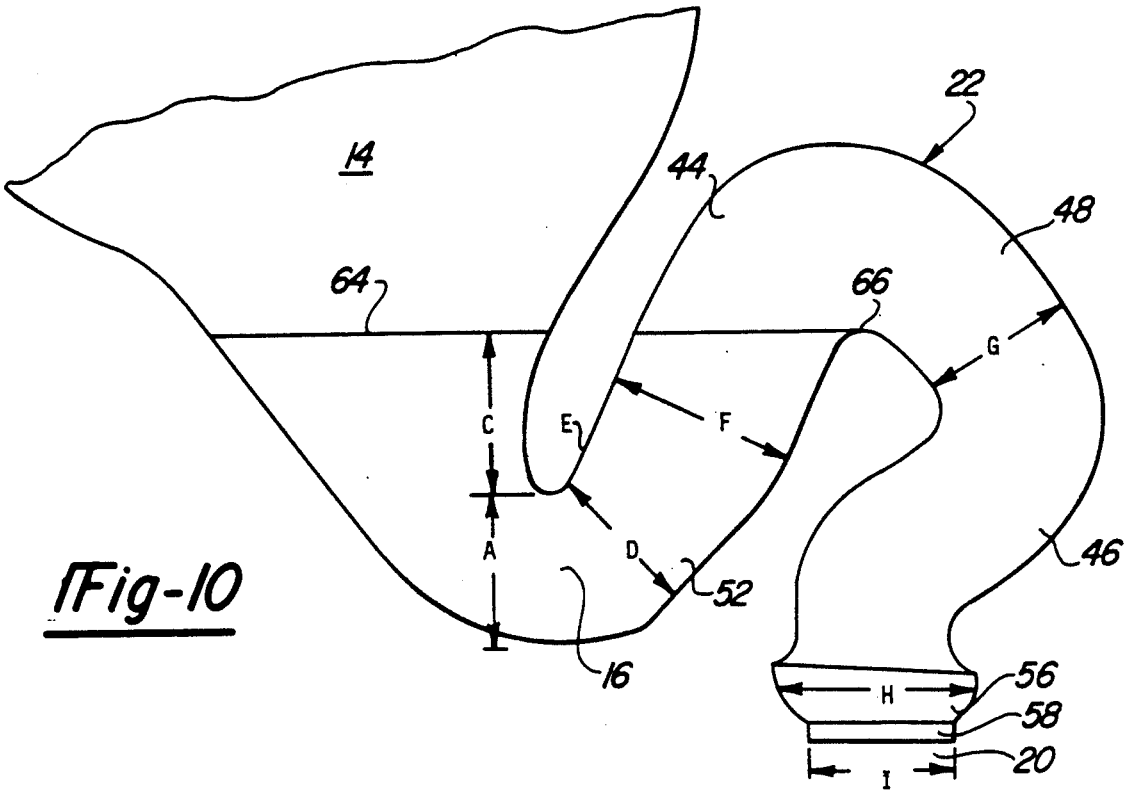
FIG. 10 is a schematic view of the waste discharge trap.

Referring to the Figures there is shown a water closet 10 including a basin 12 including a wall 14 converging downwardly to an outlet 16 and defining a frusto-hemispherical bowl, an inlet 18 defining a passage for communicating fresh flush water to the bowl, a rearwardly directed waste discharging opening 20, and a trapway 22 for communicating waste from bowl 14 to the opening. The bowl is funnel-shaped for rapidly centering waste adjacent to the outlet. While the term water closet is used for the purposes of description, the term toliet is equally applicable.

The bowl 14 is upwardly open and the wall defining same terminates in a generally oval-shaped water feed rim 24 having a circumferential rim cavity 26 which supplies fresh flush water to the bowl. A flush water trap 28 is formed between the main part of the bowl and discharge opening and acts as a seal to prevent gases and waste from returning to the bowl. The trapway works on the siphon principle to pull waste and flush water from the bowl when fresh flush water is added to the bowl at a rate faster than it can be carried away by the discharging opening.

A frusto-pyramidal flush tank 30, or cistern, is supported on bowl 14 for receiving flush water and includes a front wall 32, a rear wall 34 and a pair of sidewalls 36, the walls extending upwardly from a bottom wall 38 to form an upwardly open tank. A vertically oriented outlet 40 is positioned in bottom wall in alignment with inlet 18 to communicate flush water with water feed rim 24. A ball cock, or conventional apparatus known in the art, is disposed in the tank to bring the bowl water level to a proper seal depth. The ball cock is not shown as not being part of this invention.

Advantageously, the shape of the flush tank allows a lower head of water to be utilized. When the flushing action is initiated, the rate of flow of flush water from the tank into the trap is sufficient to start and maintain a vaccum in the trapway to initaite a siphon action during the flush operation.

Located within feed rim 24 are two flow passages 24A, 24B which communicate flush water between flush and through the rim cavity, each flow passage being of different diameter and circumferentially oriented toward the outer walls of the rim cavity. Centrally aligned relative to a horizontal underside wall of the rim is a discharge slot 42 which follows the circumference of the rim such that flush water presented to bowls is in a circumferential flow. Following the circumferential flow the flush water falls downwardly into the bowl in a swirling vortex-like movement. Advantageously, this swirling action causes the water in the bowl to rotate resulting in the waste being centered adjacent the outlet 16 from the bowl. The details of the vortex action of the rim are described more fully in my concurrently filed patent application "Toilet with Vortex Flushing Action" (S/N 249,513, filed Sept. 26, 1988), the specification specifically incorporated herein by reference.

Trapway 22 defines a continuous specially configured passageway, which is inverted and substantially "U" shaped, to direct waste from the bowl. The passageway includes an axially extending upleg portion 44, a downleg portion 46, and an axially extending transition portion 48 connecting the upleg to the downleg. The trapway changes in cross-sectional area between its ends with each portion of the pasageway being generally cylindrical relative to a central axis that generates the "U" shape.

Upleg portion has an inlet end 50 connected bowl outlet 16, a contracted cross-section or orifice 52 of smaller cross-section (area) than bowl outlet 16 to which connected, and an outlet end 54 of an expanded cross-section (and area) which is connected to the transition portion. Upleg portion has its axis disposed at an acute angle relative to a horizontal floor on which the closet is supported and extends generally vertically upwardly to the transition portion. The orifice in the upleg portion defines a converging/diverging nozzle adjacent the outlet 20 from bowl 14, the nozzle increasing the velocity of the effluent from the bowl. The expanded cross-section of the upleg receives all discharge from the bowl, serving to rapidly fill the transition portion and start the siphon action in the downleg and inhibit waste from backwashing into the bowl when the siphon is broken.

The transition portion 48 is of smaller cross-section (and area) than the upleg portion at 54 and angles downwardly at an acute angle to the floor to connect to the downleg portion. The transition portion is of constant diameter and smaller in cross-section than its connection to upleg and rapidly becomes filled to create a vaccum in the downleg.

Downleg portion 46 snakes vertically downwardly from the transition portion to the discharge opening 20 and terminates in an end portion wherein the wall 60 thereof first increases in cross-section to define a vertically disposed expansion chamber 56 and then reduces in cross-section to form a restriction or orifice 58 adjacent discharge opening 20. The downleg and discharge opening generally maintain the cross-section (and area) of the transition. The discharge opening can be the same as but preferably less than the cross-section (and area) of the transition to form orifice 58. The orifice 58 serves to choke flow from the downleg and start as siphon action.

The expansion chamber 56 operates to cause flush water that cascades downwardly through the downleg from becoming turbulent adjacent the opening. Because of the angled path of the downleg, flush water and waste is directed at an acute angle at the wall 60, defining the expansion chamber, causing the flush water to swirl and not become turbulent. The swirling motion imparted to the waste in chamber 58 aids maintenance of a solid, swirling, head of water being presented to the discharge opening, and prevents entry of air into the passageway which could break the siphon.

A brief description of the operation will now be given. The flush water from tank 30 rushes into feed rim 24 and is caused to undergo vortex motion in rim cavity 26. The converging bowl 14 tends to center the waste material in the bowl and this waste is further centered and pushed by vortex action of falling flush water from slot 42 of the feed rim into the bowl. The rapid volume of flush water presented to bowl 14 causes the waste to be driven towards and into outlet 16 in front of the flushing water. This rush of flush water starts the siphon action in trapway 22, the tank empties, the flow of fresh flush water is stopped, and the siphon sucks the water and waste from the bowl until the water level in the trap reaches the outlet of the bowl. This breaks the siphon action (this takes about 6 seconds). The water remaining in the upleg washes back into the bowl and upleg of the trap to seal the bowl and form a new water trap.

Conventional flushing allows waste to remain at the surface of the flushing water and enter the waste outlet subsequent to the majority of the water. This tends to promote inefficient disposal of waster. The present water closet, because of increased water velocity in the bowl, in combination with the pushing effect, generates superior siphonic activity. The upleg portion allows all discahrge to be pushed quickly from the bowl into the enlarged trapway, which becomes filled, creating a siphon in the downleg. As waste travels down the downleg, it is again restricted at outlet 58 which prevents air from entering the siphon and breaking the siphon.

In one embodiment, flush tank 30 has a 2.0 inch diameter (3.146 square inches area) outlet 40 on bottom wall 38 and carries about 1.5 gallons (5.100 ml.) of flush water with a 9.0 inch head. The tank is mounted on basin 12 with water feed rim 24 having a first orifice 24A of 1.25 inch diameter (1.227 square inches area) and a second orifice 24B of 0.25 inch diameter (0.491 square inches area), providing a total rim feed area of 1.276 square inches. The smaller orifice is for the rim wash action. The flush water rapidly falls from the tank, through slot 42, into the bowl 14 in a whirlpool action which rotates and centers the waste. This water has a free flow drop of about 6.0 inches through the main upper part of bowl to reach the free water level 64.

Bowl 14 funnels vertically downward from feed rim 24 to outlet 16 which defines a 2.5 inch diameter section "A" leading into trap 22. A sealed flush water trap is defined when the free surface 64 of the flush water is level with weir point 66 on transition portion 48. As indicated by dimension "C", the flush water free surface is about 2.5 inches above the bowl outlet 16. Orifice 52 defined at section "D" is formed at the entrance to the upleg by reducing the trap cross-section to a diameter of 2.25 inch (3.976 square inches area), the orifice having a contracted length "E" of about 1.5 inches and forming a nozzle to increase the velocity of the water and waste into the trap upleg. Following the orifice, the trap upleg is increased in diameter at section "F" to 3.0 inch (7.069 square inches area). This expansion area rapidly fills and helps to fill downleg 46 to initiate the siphon action and helps to keep the waste from backwashing into the bowl when the siphon is broken. The upleg diameter "F" is maintained until the transition portion 48 and downleg is started, the trap diameter then being reduced at section "G" to 2.5 inch diameter (3.976 square inch area). The trap downleg increases in diameter at "H" to a 3.125 inch diameter (7.76 sqaure inch area) to define expansion chamber 56 adjacent discharge opening 20 and then is quickly restricted in diameter at "I" to form a 2.25 inch diamter (3.976 square inch are) orifice 58 at opening 20. The expansion chamber imparts a swirling motion to the discharge effluent so that it will not be turbulent at orifice 20. The reduced diameter past the tank water trap, the transition portion, and the expansion chamber with reduced orifice help restrict the flush water flow so that the siphon can take place. The water reamining in the trap is about 775 ml. The ball cock in the tank provides 425 ml. to bring back the water level to its proper seal depth of 2.5 inches. The flush is then completed and ready to flush again.

While the above description constitutes the preferred embodiment of the invention, it will be appreciated that the invention is susceptible to modification, variation, and change without departing from the proper scope or fair meaning of the accompanying claims.

What is claim is:

1. In a water saver closet of the type including an upwardly open and downwardly converging bowl for receiving flush water and waste, and a siphon trap for communicating said water and waste from said bowl to a discharge opening, said trap comprising a continuous generally cylindrical inverted U-shaped passageway including an upleg connected to the bowl outlet, a downleg connected to the discharging opening, and an axially elongated transition leg connecting the upleg to the downleg, said U-shaped passageway axis of flow being on the same substantially vertical plane, said upleg having a first and second portion with said first portion being connected to said outlet and having a cross-section that is less than the cross-section of each said second portion and said bowl outlet whereby to define an orifice between the bowl and said transition, said downleg having a first cross-section that is less than the cross-section of said upleg second portion, and means, including a water feed rim adjacent the top of the bowl, for producing a swirling vortex movement of the flush water within the bowl whereby to cause the waste to enter the upleg prior to the entrance of the flush water into the upleg, each said leg being at an acute to a horizontal plane from said vertical plane.

2. The water closet as recited in claim 1 wherein said downleg includes means for imparting a non-turbulent swirling motion to said flush water and waste adjacent said discharge opening to prevent entry of air into said trap which could prematurely break the siphon action.

3. The water closet as recited in claim wherein said downleg includes a third and fourth portion and said means for imparting a non-turbulent swirling motion comprises a vertically extending expansion chamber being formed between said third and fourth portions, said third portion forming a continuation inlet of said transition and said downleg first portion, and said fourth portion terminating at said discharge opening.

4. The water closet as recited in claim 3 wherein the cross-section of said orifice, said discharge opening, and said inlet to said third portion are substantially the same.

5. The water closet as recited in claim 3 wherein the cross-section of said orifice, said discharge opening, said inlet to said third portion, and said first cross-section are substantially the same.

6. The water closet as recited in claim 3 wherein the expansion chamber is proximate the discharge opening and is defined by a generally vertically extending cylindrical wall positioned to be engaged by the flush water and waste discharge from the transition and the downleg first portion whereby the discharge is directed vertically downward and thereagainst upon leaving the third portion, the cylindrical wall directing the discharge so as to move into a generally swirling motion for entry into the discharge opening.

7. In combination, a flush tank disposed in operable relation to a toilet bowl having an oultet, and a siphon trap defining passageway for receiving waste from the outlet and discharging same through a discharge opening, said trap being characterized by an upleg portion connecting to the bowl, a downleg portion connecting to the discharge, an axially elongated transition leg connecting the upleg to the downleg, each said leg being at an acute angle to a horizontal plane to define an inverted U-shaped passageway, said U-shaped passageway axis of flow being in substantially the same vertical plane, a converging-diverging nozzle leading into said upleg to increase the velocity of said waste discharged into said upleg, and a vertically disposed first expansion chamber between said nozzle and discharge opening for imparting a non-turbulent swirling movement to the waste.

8. The invention as recited in claim 7 wherein said expansion chamber is disposed in said upleg, the chamber serving to allow unrestricted flow of the waste in the trap outwardly adjacent to the bowl upon release of flush water from the tank.

9. The invention as recited in claim 7 wherein said expansion chamber forms a portion of the upleg, and further comprising a vertically extending second expansion chamber adjacent said discharge opening.

10. The invention as recited in claim 9 wherein said discharge opening forms the terminus of said downleg, said second expansion chamber is defined by a cross-section that is greater than the respective cross-section of either said discharge opening or said downleg.

11. The invention as recited in claim 7 wherein said passageway is generally of cylindrical cross-section, and further comprises flow directing means, defined by a second expansion chamber in said downleg, for imparting a swirling motion to the waste material prior to being discharged through said opening, the axis of said second expansion chamber being generally vertically extending and at an acute angle to the axis of the downleg.

12. The invention as recited in claim 7 including means including a slotted water feed rim around the bowl for producing vortex motion of flush water within the trap prior to discharge through said bowl outlet.

13. A siphon trap adapted to pass effluents outwardly from a toliet bowl outlet, said siphon trap being characterized by a continuous inverted U-shaped passageway defined by an upleg including an inlet connected to the bowl outlet, said U-shaped passageway axis of flow being in substantially the same vertical plane and a converging-diverging nozzle for increasing the velocity of and directing waste from the outlet in a direction generally vertically upward, an axially elongated transition leg connected to said upleg, and a downleg portion connected to said transition leg and extending generally vertically downward therefrom to a discharge opening, each said leg being at an acute angle to a horizontal plane.

14. A siphon water closet, comprising a bowl having an outlet, means for supplying flush water to the bowl, and a siphonic trap for passing waste from the outlet to a discharge opening and preventing gases and waste water from flowing back into the bowl, said bowl being oriented so that the outlet from said bowl is vertically below the normal water level in the bowl, characterized by means for producing a vortex motion in the flush water when passed through the outlet and into the trap, said trap comprising an inverting U-shaped passage, said U-shaped passage axis of flow being in substantially the same vertical plane, said U-shaped passage formed by a vertically rising upleg portion, a vertically descending downleg portion, a converging-diverging nozzle leading into said upleg portion for increasing the velocity and volume of said waste discharged from the bowl outlet into the upleg, each said leg being at an acute angle to a horizontal plane, an orifice defining the discharge opening for restricting the flow of waste from the downleg, and a vertically extending cylindrical expansion chamber for producing swirling motion of the flush water when discharged into the discharge opening thereby preventing turbulence which could break the siphon formed when the downleg is filled with flush water.

15. A siphon trap adapted for use with a water closet having a water reservoir for receiving waste and flush water, said trap comprising a continuous inverted "U" shaped passageway including an upleg portion having an inlet connectable to said closet for receiving waste therefrom and a downleg portion having a discharge opening for discharging waste, said trap being characterized by means, including a converging diverging passageway, for increasing the velocity of volume flow rate of waste in said upleg, means, including an elongated transition leg connecting the upleg to the downleg, for rapidly creating a vacuum in the downleg when the bowl fills with flush water, the cross-section area of the transition leg being less than that where connected to the upleg whereby to rapidly fill with expanded volume flow from the upleg, means, including an expansion chamber in said downleg pipe adjacent to said opening, for causing the waste to undergo a swirling, substantially non-turbulent flow, and an orifice forming a restriction proximate said opening.

16. A siphon water closet comprising a bowl, means communicating with a water reservoir for supplying flush water to the bowl, and a rearwardly extending siphonic trap for discharging waste from the bowl and preventing gases and waste water from flowing back into the bowl, said bowl being oriented so that at least a bottom portion of said bowl is below an associated normal water level in the trap, said trap axis of flow being in substantially the same vertical plane, said trap being characterized by a vertically rising upleg passage including opposite end portions one end portion defining an inlet to said bottom portion, a vertically descending downleg passage having an outlet for discharging waste, and a transition weir forming an elongated siphon plug between the passages, the passgaes and weir being at an acute angle to a horizontal plane, the cross-sectional area of said upleg converging and diverging to form a nozzle which increases the velocity and volume of wastes presented to said siphon plug.

17. A method of reducing flush water needed to flush waste and water from a water closet of the type including a toilet bowl having a water trap and a siphon trap for transmitting the waste from the bowl outlet to a discharge opening, the steps comprising introducing flush water into the bowl in a manner that the flush water moves in a vortex vertically downward whereby to center and pass the waste in front of the flush water passing through the outlet, increasing the velocity and volume of said water and waste material in an upleg portion of the trap to rapidly fill an elongated transition leg and rapidly initiate a siphonic action in the bowl, passing the water and waste into a downleg portion of the trap, and directing the water and waste into a vertically descending expansion chamber and causing same to move in a swirling motion adjacent the opening to inhibit breaking of the siphonic action in the transition, each said leg being in substantially the same vertical plane and at an acute angle from a horizontal plane from that vertical plane.

18. A method of discharging effluent from a toliet bowl with a minimum expenditure of fresh water, the toilet having a discharge opening, a flush water trap in the bowl, and an inverted U-shaped passage extending between the bowl and the discharging opening, the passage including an upleg, a transition, and a downleg and functioning as a siphon, the steps of the method comprising simultaneously introducing fresh flush water in a swirling movement into the bowl and positioning solid effluent for entry into the upleg prior to said flush water, increasing the velocity of the effluent as it enters the upleg, by first reducing the cross-sectional area of the inlet to the upleg and then expanding the cross-section area thereof adjacent the trap, rapidly filling the transition to increase the time at which siphonic action is initiated, by reducing the cross-sectional area of the transition relative to said upleg, and rapidly filling the downleg, by decreasing the area of the downleg adjacent to the discharge opening, such that the water in the trap rises to a level higher than its level in the trap to fill the downleg at a rate faster than it can be carried away by the discharge opening to thereby start a siphoning action in the downleg.

19. The method as recited in claim 18 wherein the steps include mantaining the siphon in the downleg by directing the effluent into a generally vertically descending cylindrical chamber to initiate a substantially non-turbulent swirling movement immediately prior to entry into the opening.

20. The method as recited in claim 18 wherein the steps include directing the effluent at an acute angle against the wall of the expansion chamber, formed by increasing the area of the downleg adjacent to the discharge opening.

* * * * *

UNITED STATES PATENT AND TRADEMARK OFFICE

CERTIFICATE OF CORRECTION

PATENT NO. : 4,987,616

DATED : Jan. 29, 1991

INVENTOR(S) : Myron J. Ament

It is certified that error appears in the above-identified patent and that said Letters Patent is hereby corrected as shown below:

ON THE TITLE PAGE: U.S. Patent Documents - Patent No. 548,239, "10/1985" should be --10/1895--;

ON THE TITLE PAGE: U.S. Patent Documents - "4,162,458" should be --4,162,548--;

ON THE TITLE PAGE: Other Publications - "Fixture" should be --Fixtures--;

ON THE TITLE PAGE: Other Publications - "Portion" should be --Portions--;

ON THE TITLE PAGE: Abstract - "dischrge" should be --discharge--;

Col. 1, Line 23, "thereof" should be --therefor--;

Col. 2, Line 42, delete "the" after --with--;

Col. 3, Line 4, after "tank" insert --in--;

Col. 3, Line 6, after "of" insert --a--;

Col. 3, Line 17, "discharging" should be --discharge--;

Col. 3, Line 22, "toliet" should be --toilet--;

Col. 3, Line 27, after "and" insert --the--;

Col. 3, Line 33, "discharging" should be --discharge--;

Col. 3, Line 54, after "between" insert --the--;

UNITED STATES PATENT AND TRADEMARK OFFICE

CERTIFICATE OF CORRECTION

PATENT NO. : 4,987,616

DATED : Jan. 29, 1991

INVENTOR(S) : Myron J. Ament

It is certified that error appears in the above-identified patent and that said Letters Patent is hereby corrected as shown below:

Col. 3, Line 54, after "flush" insert --tank--;

Col. 3, Line 59, after "to" insert --the--;

Col. 3, Line 60, "bowls" should be --bowl--;

Col. 4, Line 16, after "which" insert --it is--;

Col. 4, Line 59, "could" should be --would--;

Col. 5, Line 12, "waster" should be --waste--;

Col. 5, Line 16, "discahrge" should be --discharge--;

Col. 5, Line 28, "0.491" should be --0.0491--;

Col. 5, Line 61, "are" should be --area--;

Col. 6, Line 9, "is" should be --I--;

Col. 6, Line 33, after "acute" insert --angle--;

Col. 6, Line 39, after "claim" insert --2--;

Col. 6, Line 65, "oultet" should be --outlet--;

Col. 7, Line 23, after "downleg," insert --and--;

Col. 7, Line 41, "toliet" should be --toilet--;

UNITED STATES PATENT AND TRADEMARK OFFICE

CERTIFICATE OF CORRECTION

PATENT NO. : 4,987,616

DATED : Jan. 29, 1991

INVENTOR(S) : Myron J. Ament

It is certified that error appears in the above-identified patent and that said Letters Patent is hereby corrected as shown below:

Col. 8, Lines 13-14, " "U" shaped" should be --U-shaped--;

Col. 8, Line 19, "converging diverging" should be --converging-diverging--;

Col. 8, Line 49, "passgaes" should be --passages--;

Col. 8, Line 61, after "water" insert --when--;

Col. 9, Line 6, "toliet" should be --toilet--;

Col. 9, Line 7, after "fresh" insert --flush--;

Col. 9, Line 10, "discharging" should be --discharge--.

Signed and Sealed this

Thirteenth Day of October, 1992

*Attest:*

DOUGLAS B. COMER

*Attesting Officer*

*Acting Commissioner of Patents and Trademarks*